US011542717B2

(12) United States Patent
Durin et al.

(10) Patent No.: US 11,542,717 B2
(45) Date of Patent: Jan. 3, 2023

(54) SWIMMING POOL CLEANER WITH ORIENTABLE LIQUID FLUX

(71) Applicant: ZODIAC POOL CARE EUROPE, Bron (FR)

(72) Inventors: Bruno Durin, Lauzerville (FR); Philippe Pichon, Villeneuve de Riviere (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 0 days.

(21) Appl. No.: 17/267,012

(22) PCT Filed: Sep. 26, 2019

(86) PCT No.: PCT/IB2019/058195
§ 371 (c)(1),
(2) Date: Feb. 8, 2021

(87) PCT Pub. No.: WO2020/065589
PCT Pub. Date: Apr. 2, 2020

(65) Prior Publication Data

US 2021/0301548 A1 Sep. 30, 2021

(30) Foreign Application Priority Data

Sep. 28, 2018 (FR) ..... 18/59033

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
(Continued)

(56) References Cited

U.S. PATENT DOCUMENTS

2007/0157413 A1* 7/2007 Roumagnac ..... E04H 4/1654 15/302
2011/0203060 A1 8/2011 Pichon et al.
2016/0060887 A1* 3/2016 Tryber ..... E04H 4/1654 15/1.7

FOREIGN PATENT DOCUMENTS

EP 1022411 7/2000
EP 2848751 3/2015

OTHER PUBLICATIONS

International Application No. PCT/IB2019/058195, International Preliminary Report on Patentability dated Apr. 8, 2021, 8 pages.
(Continued)

*Primary Examiner* — Fred Prince
(74) *Attorney, Agent, or Firm* — Kilpatrick Townsend & Stockton LLP

(57) ABSTRACT

A swimming pool cleaning apparatus (10) may include a body (11), a hydraulic circuit for liquid circulation between a liquid inlet (13) and a liquid outlet (14) and through a filtration chamber (17), driving and guiding members (12) of the body on a submerged surface, and defining a guide plane (XY), and an adjustment mechanism (30) for the orientation of a liquid flow, disposed at the outlet of the liquid outlet. The adjustment mechanism is adapted to direct the flow of liquid that escapes from the liquid outlet in (at least) two predefined directions, one of which (33) corresponds to a first direction inclined with respect to the guide plane and the other of which (32) corresponds to a direction substantially perpendicular to the guide plane.

11 Claims, 8 Drawing Sheets

(58) Field of Classification Search
USPC ..... 210/167.16, 167.17, 416.1, 416.2; 15/1.7
See application file for complete search history.

(56) References Cited

OTHER PUBLICATIONS

International Application No. PCT/IB2019/058195, International Search Report and Written Opinion, dated Dec. 19, 2019, 12 pages.

* cited by examiner

SWIMMING POOL CLEANER WITH ORIENTABLE LIQUID FLUX

CROSS-REFERENCE TO RELATED APPLICATION

This application claims priority to French Patent Application No. 1859033, filed Sep. 28, 2018, the entire contents of which are incorporated herein by this reference.

FIELD OF THE INVENTION

The present invention relates to the field of swimming pool equipment. It relates more particularly, but not necessarily exclusively, to an autonomous swimming pool cleaner, beneficially of the robotic type.

BACKGROUND OF THE INVENTION

The invention relates to a device for cleaning a surface immersed in a liquid, such as a surface formed by the walls of a pool, in particular a swimming pool. Such a cleaning device carries out said cleaning by traversing the bottom and walls of the pool of the pool, brushing these walls, and sucking debris to a filter. Debris means all the particles present in the basin, such as pieces of leaves, microalgae, etc., these debris being normally deposited at the bottom of the basin or adhered on the side walls thereof.

Most commonly, the pool cleaner is powered by an electrical cable connecting the apparatus to an outdoor control and power unit. We know, for example, in this field, EP 2235299 patent of the applicant (the "Pichon Patent"), which relates to a swimming pool cleaning device. Such an apparatus comprises a body, driving members of said body on the immersed surface, a filtration chamber formed within the body, a liquid inlet, a liquid outlet, and a hydraulic circuit for circulating liquid between the input and output through a filter device. The output of the hydraulic circuit is directed toward the rear of the apparatus so that the reaction to the force created by the flow of liquid has a horizontal component (or longitudinal component) and a non-zero vertical component. Such an apparatus makes it possible in particular to use drive members that consume less energy than swimming pool cleaning devices equipped with a liquid outlet of the vertical hydraulic circuit. The horizontal component of the force response created by the liquid flow is sufficient to move the body of the cleaning apparatus when the drive members are no longer in contact with the ground. In the remainder of the document, the notions of horizontal and vertical component of the reaction to the force created by the flow of liquid are associated with a cleaning apparatus rolling on a horizontal ground.

Also known is EP 1022411 (the "Erlich Patent") which discloses a swimming pool cleaning apparatus which comprises an integrated pump motor and liquid outlets out of the apparatus. This pool cleaning apparatus is configured to direct at least a portion of a hydraulic flow pumped by the pump motor to two opposite outlets of said apparatus. The hydraulic flow is used to ensure the only forward/backward changes of the device on the submerged surface of the pool. This apparatus has a conduit having two opposite ends, one toward the rear and the other toward the front, and extending parallel to the submerged surface in line with a rising channel of the aspirated liquid. A movable valve arranged at the end of the riser channel and operated by a programming device directs the liquid to one of the two opposite ends of the duct forming the two opposite outputs of the apparatus.

The change of position of the movable valve is only possible when the pump motor is stopped so that the apparatus can only change the direction of drive under the effect of the hydraulic flow by stopping the pump and restarting the latter.

These pool cleaning devices have automatic programs for cleaning the bottom of the pool and possibly the side walls of the pool. Such a program determines a cleaning of the pool in a predetermined time, for example an hour and a half. Generally, the pool cleaner is removed from the pool by the user at the end of the cycle or at regular intervals, when the filter is full of particles (leaves, microparticles, etc.), to be cleaned. In recent models, the outdoor control and power unit of the pool cleaner emits a light signal when this filter cleaning operation is to be performed.

Some of these pool cleaning devices are suitable for also cleaning the vertical walls of the pool. It has been found that, frequently, the liquid flow flushes the debris at the rear of the cleaning device when it completes its tilting from the substantially horizontal bottom to the vertical wall of the basin. In the case of cleaning devices whose liquid outlet of the hydraulic circuit is fixed and directed toward the rear, the reaction to the force created by the flow of liquid, opposing the effort created by the driving means must be significantly reduced when the pool cleaning devices move in reverse. The debris suctioning power is consequently reduced.

An object of the invention is to overcome this drawback.

SUMMARY OF THE INVENTION

The invention aims in a first aspect to provide a swimming pool cleaning apparatus comprising: a body, a hydraulic circuit for liquid circulation between a liquid inlet and a liquid outlet, and through a filtration chamber, driving and guiding members of the body on a submerged surface, and defining a guide plane, and means for adjusting the orientation of a liquid flow, disposed at or near the outlet of the liquid outlet.

The adjustment means are adapted and configured to orient the flow of liquid that escapes or exits from the liquid outlet in (at least) two predefined directions, one of which corresponds to a first direction inclined relative to the guide plane, and the other of which corresponds to a direction substantially perpendicular to the guide plane.

The term substantially means that the component of the reaction force created by the nominal flow of liquid flow, parallel to the guide plane, remains lower than the force created by the drive and guiding members. The nominal suction power of the debris is thus maintained.

Beneficially, the adjusting means are adapted and configured to orient the flow of liquid that escapes from the liquid outlet in two predefined directions, one of which corresponds to a first direction inclined toward the rear of the pool cleaning apparatus with respect to the guide plane, and the other corresponds to a direction substantially perpendicular to the guide plane.

The guiding plane is equivalent to the running surface of the pool cleaner. When said swimming pool cleaning apparatus moves on a submerged surface of the swimming pool, the guide plane merges with a contact surface between the drive and guiding members of the body of the pool cleaner and the surface immersed on which it moves. A direction perpendicular to the guide plane is vertical—in a fixed reference: linked to the pool—when the device moves on a horizontal surface—such as a pool bottom. A direction perpendicular to the guide plane is horizontal—in a fixed reference linked to the pool—when the device moves on a vertical surface—such as a wall of the pool.

The adjustment means are advantageously located immediately downstream of the liquid outlet, in a longitudinal vertical plane of the body of the pool cleaning apparatus.

The term "pool cleaning apparatus" is intended to mean an apparatus for cleaning a submerged surface, that is to say typically a device, mobile within or at the bottom of a swimming pool, and adapted to carry out the filtration of debris deposited at the bottom of the pool or adhered on the side walls thereof (or suspended in the water of the pool). Such an apparatus is commonly known as a pool cleaning robot, when it comprises means of automated management of movements at the bottom and on the walls of the pool to cover the entire surface to be cleaned. The invention may have applicability as well to non-robotic pool cleaning apparatus.

The adjustment means advantageously make it possible to maintain or modify the orientation of the liquid flow according to the displacement of the pool cleaning device in the pool.

The substantially vertical position normally always refers to the guide plane of the pool cleaning device.

In one configuration, the adjustment means make it possible to modify the orientation of the liquid flow at the outlet of the liquid outlet (coming from the hydraulic circuit) from a position inclined with respect to the guide plane, in particular toward the rear of the pool cleaning apparatus, to a position substantially perpendicular to the guide plane of the pool cleaning apparatus.

In this configuration, the liquid flow no longer flushes the debris at the back of the pool cleaner, when it finishes its tilting from the bottom to the vertical wall of the pool.

In another configuration possibly implemented in conjunction with the previous configuration, the adjustment means make it possible to maintain the orientation of the liquid flow at the outlet of the liquid outlet (coming from the hydraulic circuit) in a position substantially perpendicular to the plane guide when the pool cleaner flips from the vertical wall of the pool to the bottom of the pool in reverse. It is thus no longer necessary to significantly reduce the suction power of the debris.

In another configuration, possibly implemented in conjunction with one or more of the preceding configurations, the adjustment means make it possible to modify the orientation of the liquid flow at the outlet of the liquid outlet (from the hydraulic circuit), from a position substantially perpendicular to the guide plane to a position inclined relative to the guide plane, in particular toward the rear of the swimming pool cleaning apparatus, when the pool cleaning apparatus is on the bottom of the basin.

According to particular embodiments, the pool cleaning apparatus may have one or more of the following features, implemented separately or in each of their technically operating combinations.

In one exemplary embodiment, the adjustment means are in the form of a nozzle, preferably of constant section. The adjustment means comprise a nozzle body. The nozzle body may be attached to the body of the pool cleaner. The nozzle body has an inlet port, arranged opposite the liquid outlet of the apparatus. In certain embodiments, the nozzle body includes outlet orifices having different inclinations relative to the body of the pool cleaner.

The Nozzle Body Comprises:

a first outlet orifice adapted and configured to allow the liquid coming from the liquid outlet to escape in the direction substantially perpendicular to the guide plane;

a second liquid outlet orifice adapted to and configured to allow the liquid coming from the liquid outlet to escape in the direction inclined with respect to the guide plane.

In one embodiment, the adjustment means comprise a closure device. The closure device is preferably configured to close at least one of the liquid outlet orifices of the nozzle body. The closure device is preferably adapted to close off either the first liquid outlet orifice or the second liquid outlet orifice.

In an exemplary embodiment, the orientation device is a valve.

In an exemplary embodiment, the closure device is movable, preferably between two positions. In each position, one of the outlet ports of the nozzle body is plugged. In particular embodiments, the closure or shutter device, in a first position, only closes the first liquid outlet port when the swimming pool cleaner, in operation, is moving on a horizontal surface—within the boundaries of the pool—such as for example the bottom of the pool. In other words, the shutter device, in a first position, closes only the first liquid outlet orifice when the guide plane is parallel, or tangent, to the bottom of the pool.

In particular embodiments, the shutter device, in a second position, closes only the second liquid outlet port when the swimming pool cleaner, in operation, is moving on a vertical surface—within the boundaries of the pool—such as for example the vertical wall of the pool. In other words, the shutter device, in a second position, closes only the second liquid outlet port when the guide plane of the pool cleaning device is parallel to, or tangent to, the vertical wall of the pool.

In preferred embodiments, the nozzle body comprises a single outlet orifice arranged to allow the liquid coming from the liquid outlet to escape in the direction substantially perpendicular to die guide plane and in the direction inclined with respect to the guiding plane. The adjustment means comprise a closure device adapted to close off a first portion of said outlet orifice so as to allow the liquid coming from the liquid outlet to escape in the direction inclined with respect to the guide plane, or a second portion of said outlet port so as to allow the liquid from the liquid outlet to escape in the direction substantially perpendicular to the guide plane.

In exemplary embodiments associated with these alternative embodiments, the closure device, in a first position, closes only the first portion of the outlet orifice when the pool cleaning, apparatus, in operation, moves on a horizontal surface—in the reference linked to the pool—such as for example the bottom of the pool. In other words, the shutter device, in a first position, closes only the first portion of the liquid outlet orifice when the guide plane is parallel, or tangent, at the bottom of the pool.

In exemplary embodiments associated with these embodiments, the closure device, in a second position, closes only the second portion of the outlet orifice when the pool cleaning apparatus, in operation, moves on a vertical surface—in the reference linked to the pool—such as for example the vertical wall of the pool. In other words, the shutter device, in a second position, closes only the second liquid outlet port when the guide plane of the pool cleaning device is parallel to, or tangent to, the vertical wall of the pool.

In particular embodiments, the adjustment means comprise at least one flyweight, or ballast.

The at least one flyweight is adapted to bring the closure device in one or the other of the positions according to the positioning of said pool cleaning device in the pool. The at least one flyweight is fixedly secured to the closure device. The at least one flyweight moves the closure device when the body of the swimming pool cleaner body changes and passes beyond a particular and predefined threshold.

The at least one flyweight advantageously makes it possible to move the positioning, of the closure device in one of the two positions solely by the action of its mass and gravity. The at least one flyweight is advantageously dimensioned and positioned so as to naturally maintain the closure device in one of the two positions.

In particular embodiments, the swimming pool cleaning device comprises a blade located in the flow of liquid. The blade is preferably fixed integrally to the closure device. The blade is arranged to oppose in part the flow of liquid escaping from the liquid outlet, when the closure device is in the second position. The blade is advantageously configured to generate a displacement force of the shutter device as a function of the speed of the liquid flow at the outlet of the hydraulic circuit.

In particular embodiments, the adjustment means comprise a blade fixedly attached to the closure device, arranged so as not to oppose in part the flow of liquid escaping from the liquid outlet, when said closure device is in the first position.

In particular embodiments, the closure device remains in a second position (closing only the second liquid outlet orifice or the second portion of the single outlet orifice, according to the variant of the nozzle body), when the swimming pool cleaner, in operation, moves from a vertical surface to a horizontal surface.

In particular embodiments, the closure device passes from a second position, (closing only the second liquid outlet orifice or the second portion of the single outlet orifice, according to the variant of the nozzle body), to a first position (closing only the first liquid outlet or the first portion of the single outlet, depending on the variant of the nozzle body), when the pool cleaning apparatus, in operation, moves on a horizontal surface and the power of a circulation pump becomes lower than a predetermined non-zero threshold.

In particular embodiments, the apparatus comprises a return member, for example a return spring. This return member is advantageously configured to create an offset between the displacement of the closure device and the change of attitude of the pool cleaning device. The return member is arranged, and configured, so as to anticipate or delay the passage of the shutter device from the first position to the second position when said apparatus, in operation, tilts from a bottom of the pool to a vertical wall of the swimming pool.

In particular embodiments, the pool cleaning apparatus comprises a pallet. The pallet is preferably fixed on the closure device. The pallet is preferably located outside the nozzle body. The pallet is advantageously configured to generate a displacement force of the shutter device dependent on the speed and direction of movement of the body of the pool cleaning apparatus.

BRIEF DESCRIPTION OF THE DRAWINGS

The description is based on the appended figures in which.

DETAILED DESCRIPTION

The invention finds its place in, for example, a swimming, pool technical environment, e.g. a family-type in-ground pool.

A submerged surface cleaning system includes, in the present non-limiting exemplary embodiment, a swimming pool cleaning apparatus 10 and a power supply and control unit of said pool cleaning apparatus (not shown in the figures). In an alternative embodiment, this power supply and control unit can be integrated into the swimming pool cleaning device.

Figure 1:
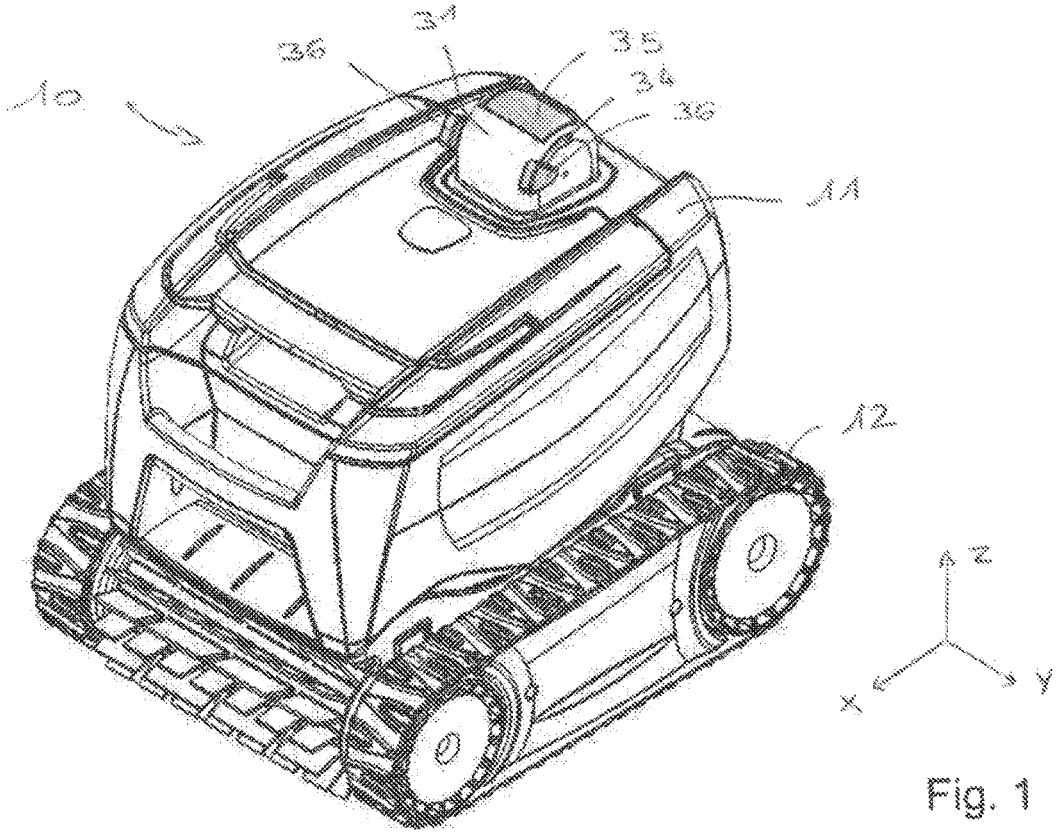
FIG. 1 illustrates a perspective view from the front of a swimming pool cleaning device as exposed—in a liquid flow position toward the rear.
Figure 2:
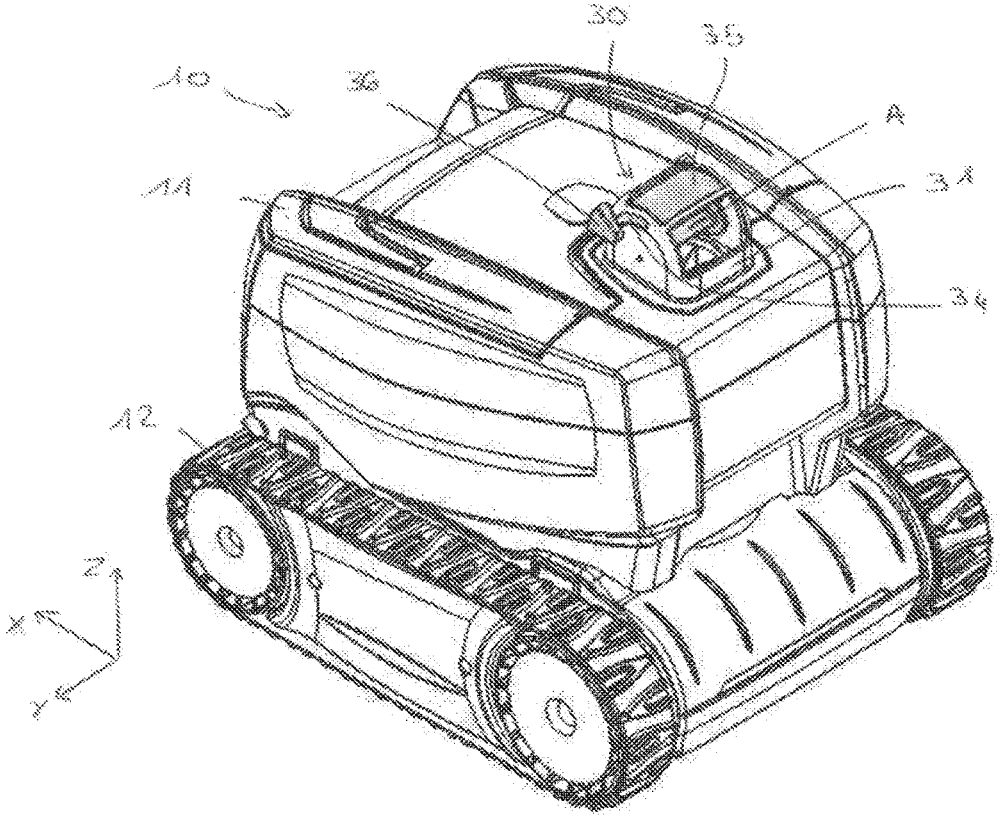
FIG. 2 illustrates a perspective view from the rear of a swimming pool cleaning device as exposed—in the liquid flow position toward the rear.

The pool cleaning apparatus 10 is shown according to an embodiment given here by way of example, in FIGS. 1I and 2. In these figures, the type of swimming pool cleaning apparatus 10 has an exit jet inclined toward the rear relative to a running surface, or guide plane, of the pool cleaning device. An alternative arrangement in which the pool cleaning apparatus comprises a liquid ejection perpendicular to the guide plane of the pool cleaning, apparatus is also conceivable.

The pool cleaning apparatus 10 comprises a body 11 and driving and guiding members 12 of the body 11 on a submerged surface. In the present non-limiting example, these driving and guiding members 12 may include wheels or caterpillars (tracks) arranged laterally to the body (see FIG. 1).

The driving and guiding members 12 define an XY guide plane on an immersed surface by their points of contact with said immersed surface. Said guide plane is generally substantially tangential to the submerged surface at the point where the pool cleaning apparatus is located. Said XY guide plane is for example substantially horizontal when the pool cleaning device moves on a submerged surface of the pool bottom. Said XY guide plane is for example substantially vertical when the pool cleaning device moves on a vertical wall of the pool.

Throughout the text the notions "up" and "down" are defined along a line Z, normal to said XY guide plane. A "low" element is closer to the guide plane than a high element. The axis of displacement of the pool cleaning apparatus is said longitudinal axis X, and the axis perpendicular to this direction in the XY guide plane is said transverse axis Y. The axis perpendicular to the guide plane is said axis vertical Z. The X, Y and Z axes define an orthonormal XYZ coordinate system.

The pool cleaning apparatus further comprises a motor driving said driving and guiding members. Said motor is, in the present example, powered by the power supply and control unit via a flexible cable.

Figure 4A:
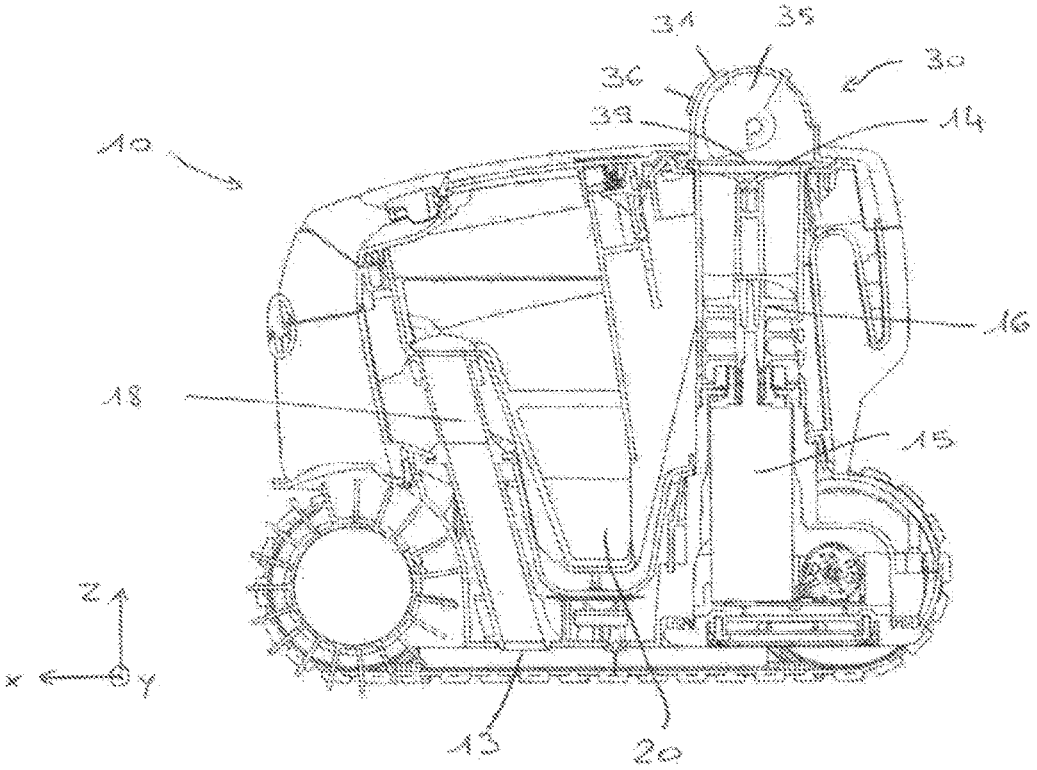
FIG. 4*a* illustrates a sectional view, in the vertical longitudinal plane, of a swimming pool cleaning device—in the liquid flow position toward the rear.

The pool cleaning apparatus 10 has at least one liquid inlet 13 and a liquid outlet 14 (see FIG. 4*a*). The liquid inlet 13 is preferably located at the base of the body (in other words below it), that is to say immediately facing a submerged surface on which the cleaning apparatus moves in order to be able to suction debris accumulated on said submerged surface. The immersed surface can thus be either the bottom of the pool or a side wall of said pool (or otherwise as appropriate).

In the non-limiting exemplary embodiment, the liquid outlet 14 is located here on the top of the pool cleaning apparatus. In the present example, the liquid outlet 14 is in a plane substantially parallel to the XY guide plane. The liquid outlet 14 forms an opening in an upper face of the body 11 of the pool cleaning apparatus 10.

The pool cleaning apparatus 10 comprises a hydraulic circuit connecting the liquid inlet 13 to the liquid outlet 14. The hydraulic circuit is adapted to be able to ensure a circulation of liquid from the liquid inlet 13 to the liquid outlet 14. For example, the pool cleaning device comprises a circulation pump. The circulation pump comprises, for example, an electric motor 15 and a propeller 16 (see FIG. 4*a*). Said electric motor 15 drives the propeller 16 in rotation. Said propeller 16 is disposed in the hydraulic circuit.

The pool cleaning apparatus 10 preferably comprises a filtration chamber 17. Said filtration chamber is interposed, on the hydraulic circuit, between the liquid inlet 13 and the liquid outlet 14. The filtration chamber is in particular supplied with liquid via at least one upstream channel 18 connecting the liquid inlet 13 to the filtration chamber 17, as illustrated in FIG. 4*a*.

The filtration chamber 17 may comprise a filtration basket 20, as shown in FIG. 4*a*. This filter basket 20 is advantageously but not necessarily removable.

In one embodiment, the pool cleaning apparatus includes means for adjusting the orientation of the liquid flow.

Said adjustment means are for example in the form of a nozzle 30, as shown in FIG. 2. A nozzle means a duct comprising at least one inlet and at least one outlet, which makes it possible to impose on the fluid, flowing in said duct, determined characteristics of speed and/or flow direction at the outlet of said duct.

The adjustment means 30 are preferably located outside the body 11 of the pool cleaning device 10, for example at an upper face or surface of said body. The adjustment means 30 are arranged immediately downstream and opposite the liquid outlet 14 of the body of the swimming pool cleaning apparatus 10, in other words, the adjustment means 30 are placed at or proximate the liquid outlet 14. The adjustment means 30 may form an outgrowth on or extension of the upper face or surface of the body of the pool cleaner. The adjustment means 30 are adapted to direct the flow of liquid that escapes from the liquid outlet 14 in at least two predefined directions, at least one of which corresponds to a first inclined direction, preferably toward the rear of the pool cleaning apparatus, with respect to the XY guide plane and the other of which corresponds to a direction substantially perpendicular to the XY guide plane. Persons skilled in the relevant art will recognize that adjustment means 30 alternatively or additionally may direct liquid flow in other directions, either predefined or dynamically determined.

Advantageously, the adjustment means 30 are adapted to orient the flow of liquid that escapes from the liquid outlet 14 in two predefined directions, one of which corresponds to a first inclined direction, preferably toward the rear of the swimming pool cleaning apparatus, with respect to the XY guide plane, beneficially at an angle between approximately 20 and 50°, and the other of which corresponds to a direction substantially perpendicular to the XY guide plane, advantageously at an angle between approximately 75 and 105°. These angles correspond to the median angle of the flow of liquid leaving the adjustment means 30. Other inclination angles may be achieved or utilized instead, however.

The adjustment means 30 comprise a nozzle body 31. The nozzle body 31 defines a volume and has, preferably, a shape adapted to guide the flow of liquid in at least both of the above-described directions.

The nozzle body 31 may resemble a deflector member and have a plurality of orifices.

The nozzle body 31 has an inlet 39 of liquid. Said inlet orifice 39 is preferably located opposite the liquid outlet 14 of the body 11 of the pool cleaning apparatus 10. In the non-limiting example, where the liquid outlet 14 of the body 11 of the pool cleaning apparatus 10 is disposed at the upper face of the body 11 of the pool cleaning apparatus 10, said inlet port 39 is substantially parallel to the XY guide plane. The inlet orifice 39 is advantageously dimensioned with respect to the liquid outlet 14, and preferably has at least the same dimension as the liquid outlet 14.

In a preferred embodiment of the nozzle body, said nozzle body 31 has a first liquid outlet port 32. The first outlet orifice 32 is preferably substantially in facing relation with the inlet orifice 39 of liquid. The first liquid outlet port 32 is substantially parallel to the XY guide plane.

The first outlet port 32 is arranged and configured to allow liquid to escape from the liquid outlet 14 in a direction substantially perpendicular to the XY guide plane. The nozzle body 31 has a second liquid outlet port 33.

The second liquid outlet orifice 33 is arranged and configured to allow the liquid coming from the liquid outlet 14 to escape in a direction inclined with respect to the XY guide plane, preferably toward a rear part of the cleaning apparatus 10. The second outlet port 33 thus is inclined relative to the XY guide plane.

In a non-limiting embodiment, illustrated in FIGS. 4*a* to 7*b*, the nozzle body 31 defines a volume delimited by a substantially cylindrical wall and two lateral faces. The two lateral faces form the bases of the substantially cylindrical wall. Said lateral faces close the transverse ends of the substantially cylindrical wall. The cylindrical wall has openings forming the orifices 32, 33, 39. The inlet orifice 39, the first liquid outlet port 32 and the second outlet port 33 are formed in the substantially cylindrical wall. The nozzle body 31 is preferably configured so that an axis of revolution of the substantially cylindrical wall is substantially parallel to the transverse axis Y of the pool cleaning apparatus 10.

Figure 8:
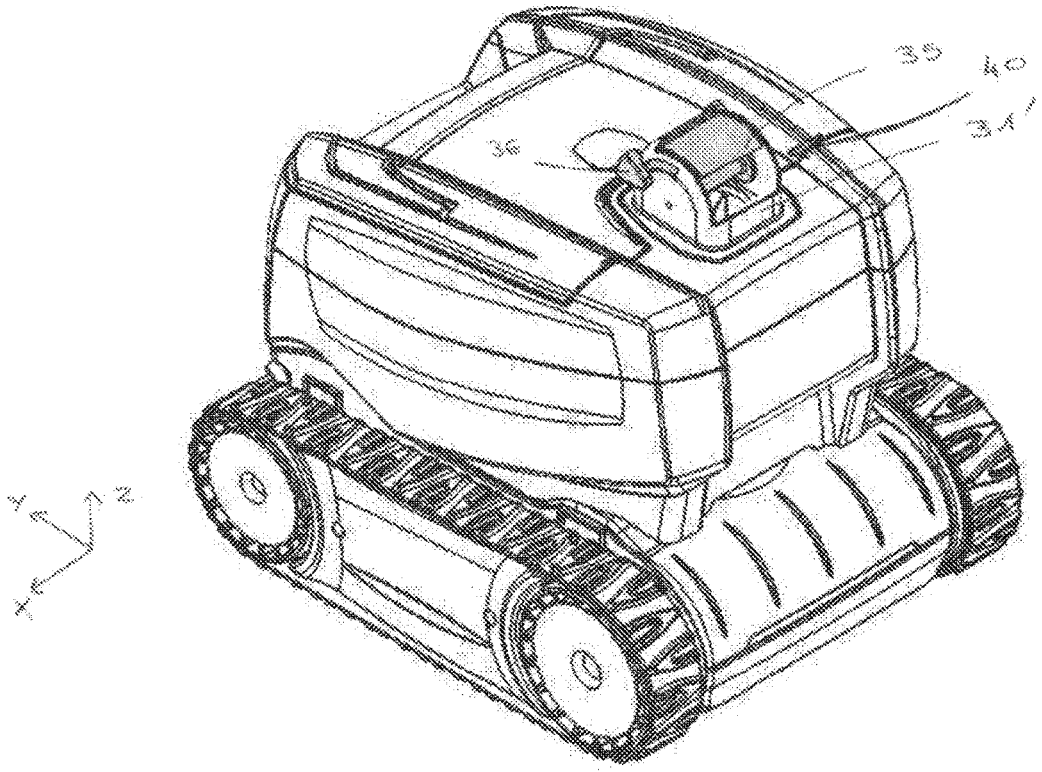
FIG. 8 illustrates another example of a pool cleaning apparatus with a variant embodiment of a nozzle body.
Figure 9A:
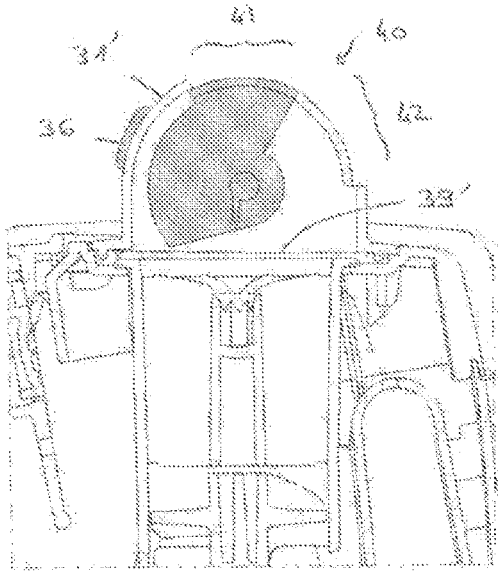
FIG. 9*a* illustrates a cross-sectional view, in the vertical longitudinal plane, of the pool cleaning apparatus of FIG. 8—in the liquid flow position toward the rear.
Figure 9B:
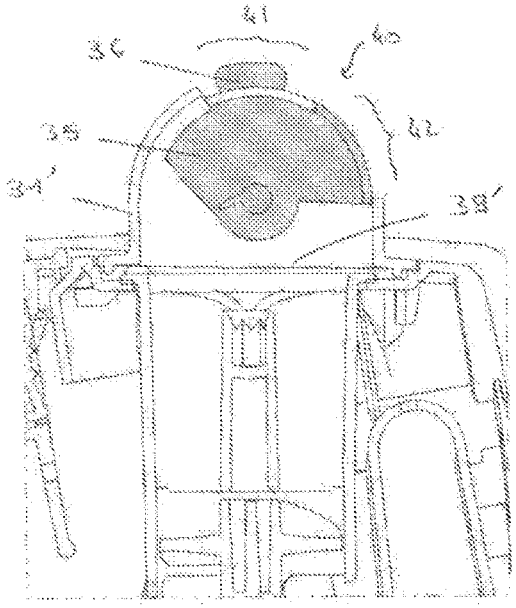
FIG. 9*b* illustrates a sectional view, in the vertical longitudinal plane, of the pool cleaning apparatus of FIG. 8—in the upward liquid flow position.

In an alternative embodiment of the nozzle body, as illustrated in FIGS. 8, 9*a* and 9*b*, said nozzle body 31' has a liquid inlet 39'. Said inlet orifice 39' is preferably located opposite the liquid outlet 14 of the body 11 of the pool cleaning apparatus 10. The nozzle body 31' comprises a single outlet orifice 40 of liquid. The single outlet orifice 40 is arranged and configured to allow the liquid coming from the liquid outlet 14 to escape in the direction substantially perpendicular to the XY guide plane and in the direction inclined relative to the XY guide plane. The nozzle body 31' may have a shape similar to that of the nozzle body 31.

In at least one embodiment, the adjustment means 30 further comprise a closure device 35. The closure device 35 is adapted and configured to close either the first liquid outlet port 32 or the second liquid outlet port 33. The shutter or closure device preferably cannot completely close the two liquid outlet ports simultaneously.

In an exemplary embodiment, the closure device 35 is disposed in the volume of the nozzle body 31. The closure device 35 preferably has a suitable shape, for example a substantially complementary shape, to an internal shape of the nozzle body 31 so that the entire flow of liquid from the liquid outlet 14 of the body 11 of the pool cleaning apparatus 10 is directed toward one of the two outlet orifices 32 or 33 depending on the orientation of the closure device 35.

In a non-limiting embodiment, illustrated by FIGS. 3*a* to 7*b*, the closure device 35 has, for example, a shape complementary to an internal face of the substantially cylindrical wall of the nozzle body 31. The closure device 35 is rotatable about a hinge axis A, for example merged with the axis of the nozzle body 31, preferably between two positions.

Figure 3A:
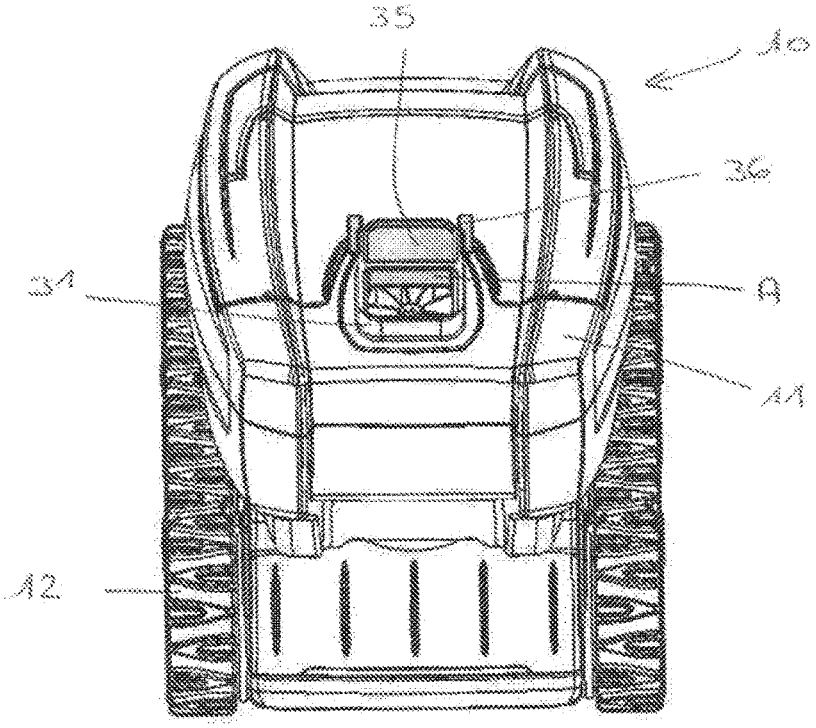
FIG. 3*a* illustrates a perspective view from the rear of a swimming pool cleaning device as exposed—in a liquid flow position toward the rear.
Figure 3B:
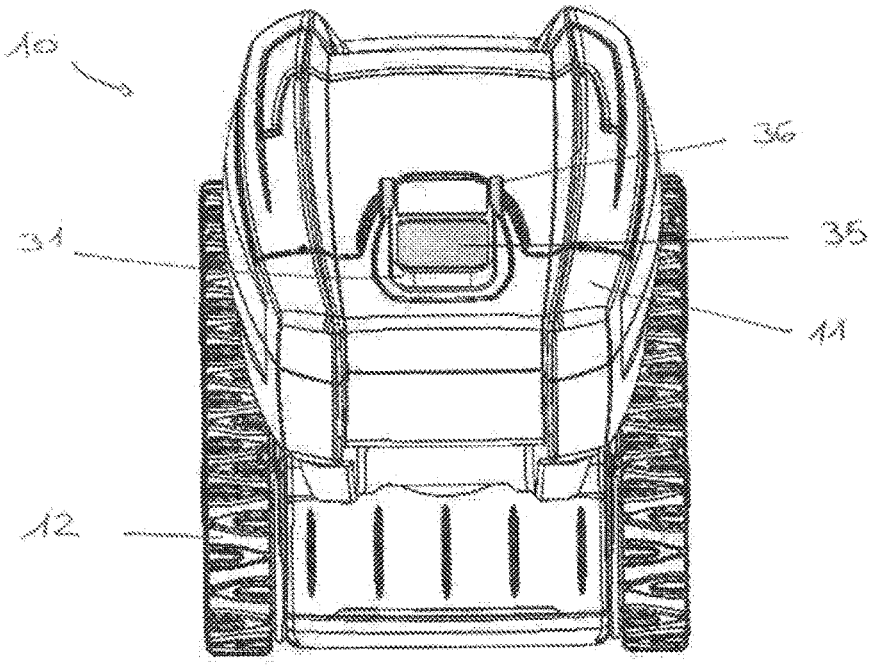
FIG. 3*b* illustrates a rear perspective view of a swimming pool cleaner—in the upward liquid flow position.
Figure 4B:
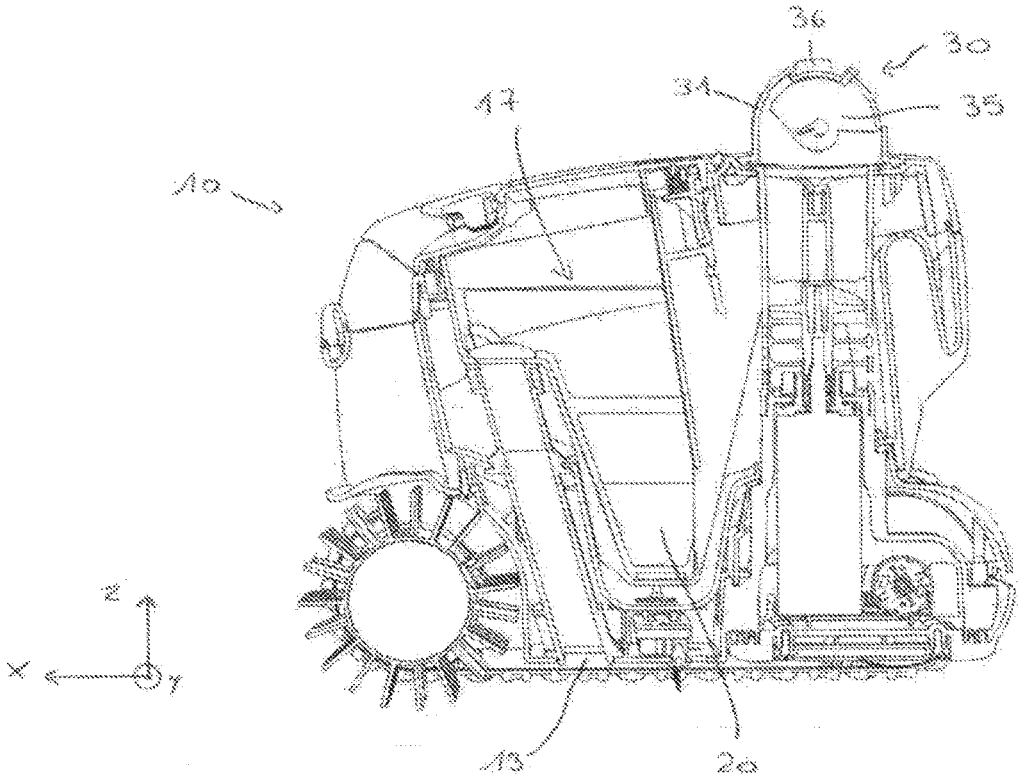
FIG. 4*b* illustrates a sectional view, in the vertical longitudinal plane, of a pool cleaning apparatus—in the upward liquid flow position.

The closure device 35 is arranged, so that:

- in a first position, the first liquid outlet port 32 is plugged while the second liquid outlet port 33 is open (FIGS. 3*a* and 4*a*), and
- in a second position, the second outlet orifice 33 is plugged while the first outlet orifice 32 is open (FIGS. 3*b* and 4*b*).

The closure device 35 may, but need not necessarily, be integrally bonded to the nozzle body 31. In an exemplary embodiment, the closure device 35 is connected to the nozzle body, at the side faces of said nozzle body. The term "integral" or "integrally" is used when it refers to parts with respect to each other in a conventional manner in itself, that said parts are mutually related, a relative movement between them may, however, be possible.

In the embodiment where the nozzle body 31' has only one outlet, the closure device 35 of the adjustment means 30 is then arranged and configured to close off either (i) a first portion 41 of said outlet port 40 of liquid so as to allow the liquid coming from the liquid outlet 14 to escape in the direction inclined with respect to the XY guide plane, or (ii) a second portion 42 of said outlet orifice to let out the liquid coming from the outlet of liquid 14 in the direction substantially perpendicular to the XY guide plane. The closure device 35 preferably cannot completely close the single liquid outlet port 40 of the nozzle body 31'. The closure device 35 is arranged, so that:

- in its first position, the closure device closes only the first portion 41 of the outlet orifice 40 (FIG. 9*a*), and
- in its second position, the closure device closes only the second portion 42 of the outlet orifice 40 (FIG. 9*a*).

In one embodiment, the adjustment means 30 comprise at least one flyweight 36, fixedly secured to the closure device 35, whatever the embodiment variant of the nozzle body. Said at least one flyweight 36 moves the closure device 35 from one position to another. The at least one flyweight 36 is preferably located outside the nozzle body.

In an exemplary embodiment (not shown in the figures), when the adjustment means 30 comprise a single flyweight 36, said flyweight may be positioned in a plane of symmetry of the lateral faces of the nozzle body. Arms (not shown) are arranged to make the weight fixedly secured to the closure device 35.

In at least one embodiment illustrated in FIG. 1, the adjustment means 30 comprise two flyweights 36, fixedly secured to the closure device 35. Said flyweights 36 have a center of gravity remote from the articulation axis A. Weights 36 are preferably located outside the nozzle body 31, for example at the side faces of the nozzle body. A notch 34 may for example be provided in each lateral face of the nozzle body 31 to allow the fixedly secured connection between the weights 36 and the closure device 35. The force of the weights preferably is in the plane of symmetry respecting lateral faces of the nozzle body 31 so as not to generate unbalanced forces on the two bearings of the hinge pin at axis A.

The weights 36 are dimensioned and arranged so that:

- when the pool cleaning apparatus 10 is immersed, said pool cleaning apparatus falls on a horizontal surface of the pool, such as the bottom of the pool, the motors being not powered, said weights tending to maintain the closure device 35 in its first position,
- when the pool cleaning apparatus 10, in operation, moves on a horizontal surface of the pool, such as the bottom of the swimming pool, said weights 36 tend to keep the closure device 35 in its first position,
- when the pool cleaning apparatus 10, in operation, moves on a vertical surface of the pool, such as the vertical wall of the pool, said weights 36 tend to maintain the closure device 35 in its second position.

The weights 36 are sized and arranged so that only the action of the mass of the weights 36 intervenes, according to the law of gravity. No intervention of any actuator is required to move the closure device from one position to the other or to maintain the closure device in one of two positions.

Figure 5A:
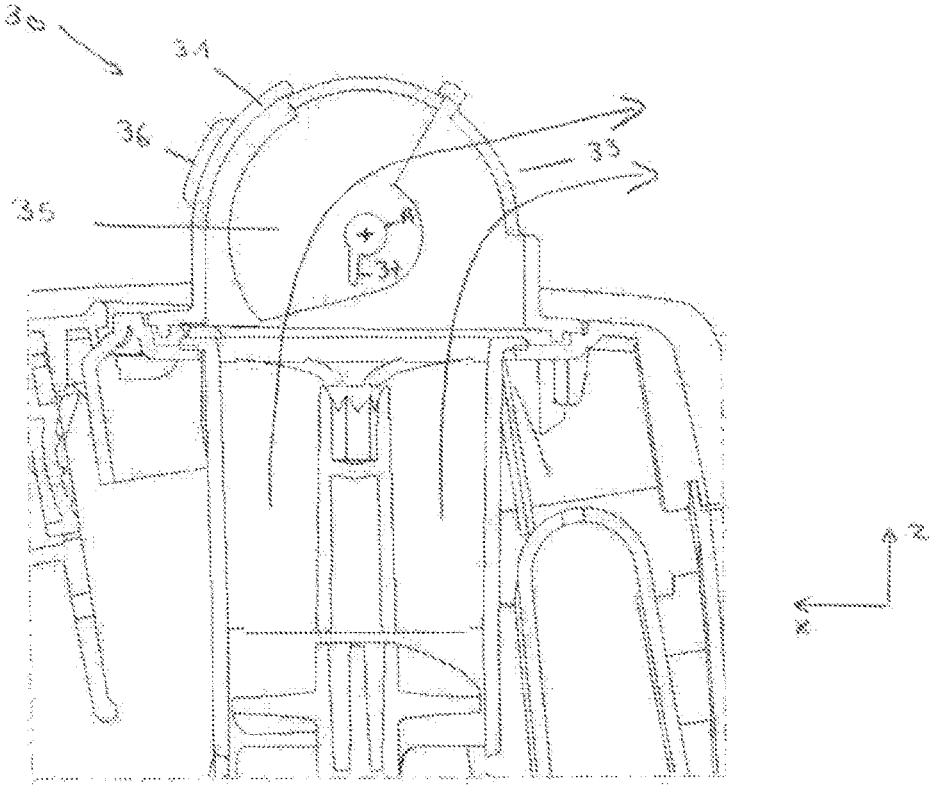
FIGS. 5*a* and 5*b* illustrate the operation of an apparatus that is a subject of the invention when the body of the pool cleaning apparatus moves on a substantially horizontal surface.

In one embodiment, the adjustment means 30 comprise a blade 37 fixedly attached to the closure device 35, whatever the embodiment of the nozzle body. As illustrated for example in FIGS. 5*a* to 7*a*, the blade 37 is advantageously configured to generate a displacement force of the closure device 35 as a function of the speed of the flow of liquid at the outlet of the hydraulic circuit. The blade 37 is arranged in the flow of liquid, preferably fixed on the hinge pin A. The blade 37 is arranged so that its center of gravity is distant from the hinge axis A. The blade 37 is arranged to partially oppose the flow of liquid escaping from the liquid outlet 14, when the closure device 35 is in the second position. In other words, the orientation of the blade 37 is secant with the flow liquid entering through the liquid inlet 39, when the closure device 35 is in the second position (FIGS. 6*a* and 7*a*). The blade 37 is arranged not to oppose in part the flow of liquid escaping from the liquid outlet 14, when the closure device 35 is in the first position. In other words, the orientation of the blade 37 is parallel to the flow of liquid entering through the liquid inlet 39 when the closure device 35 is in the first position (FIG. 5*a*). The operation of the blade is identical with the nozzle body 31'.

Operating Mode

Figure 5B:
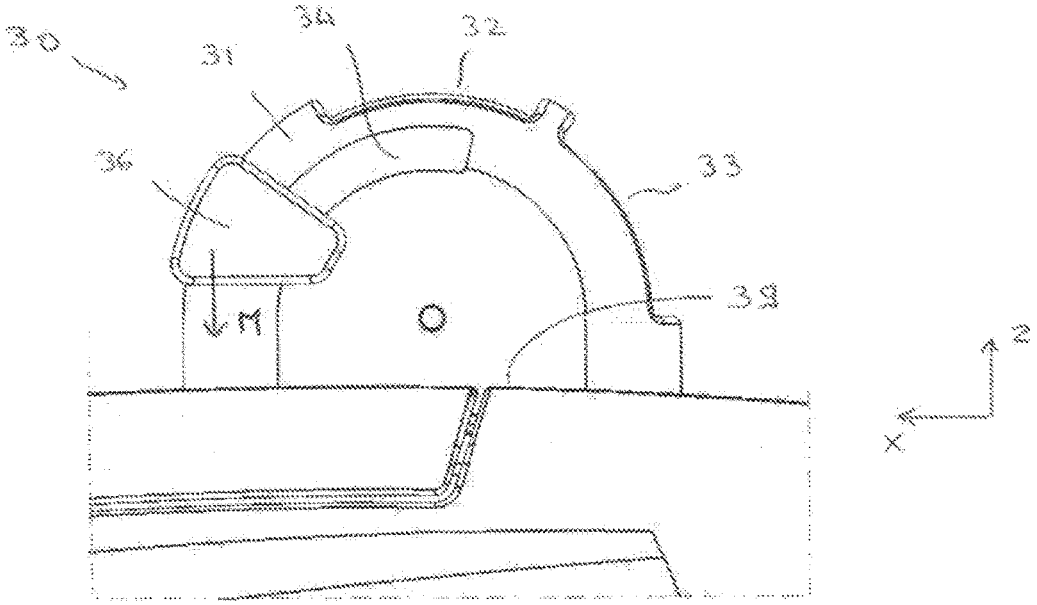
Figure 6A:
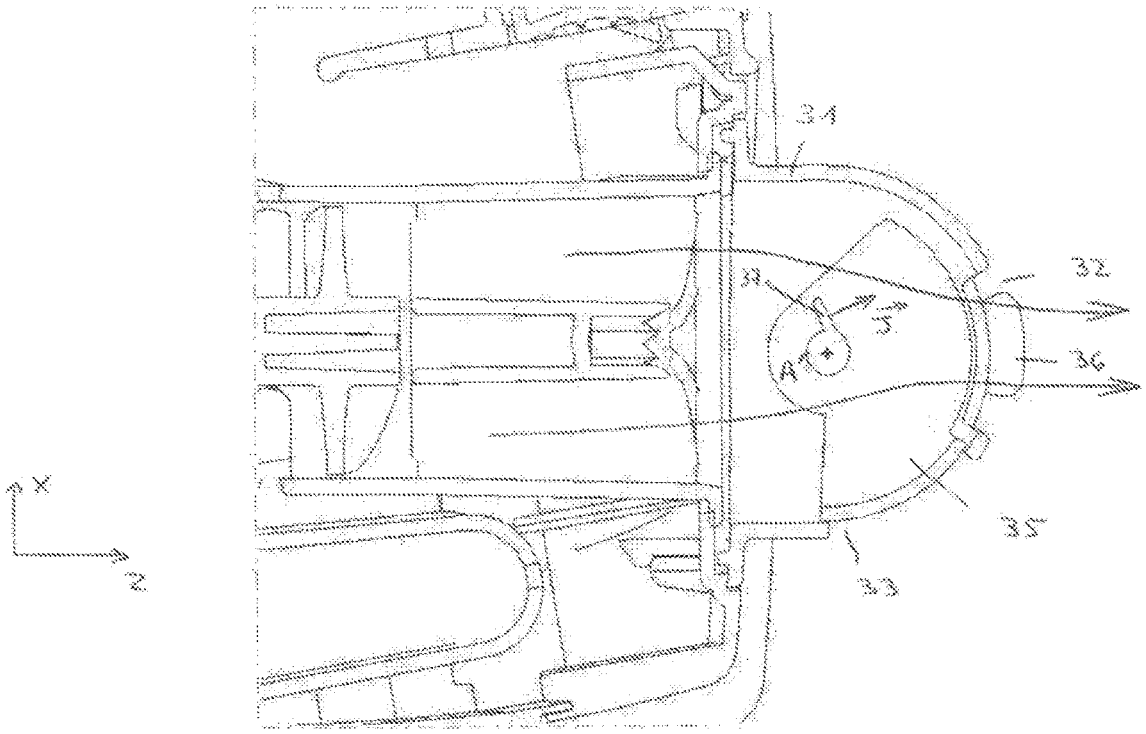
FIGS. 6*a* and 6*b* illustrate the operation of an apparatus that is a subject of the invention when the body of the pool cleaning apparatus moves over a substantially vertical surface.

When the swimming pool cleaner is immersed, it falls on a horizontal surface of the pool, such as the bottom of the pool, the engines are not powered, the torque generated by the weights 36 tends to bring the closure device 35 in its first position (see FIGS. 5*a* and 5*b*).

When the pool cleaner is moving into the pool, liquid enters the body of said pool cleaner through the liquid inlet 13 disposed beneath the apparatus. Said liquid passes into the upstream channel 18 to reach the filtration chamber 17. The filtration chamber passes the liquid and retains the solid debris. The filtered liquid is then directed to the liquid outlet 14, and is ejected outside the pool cleaning apparatus, via the adjustment means 30. The liquid outlet 14 facing, the propeller of the circulation pump, the liquid flows out of said pool cleaning apparatus by said liquid outlet with a nominal speed V.

FIGS. 5*a* to 7*b* illustrate a mode of operation of the adjustment means 30 of the orientation of the liquid flow, with a nozzle body comprising two liquid outlet orifices without this being, limiting, of the invention. In the case where the nozzle body comprises a single outlet orifice 40, the operating mode of the liquid flow direction adjustment means applies by analogy.

Figure 7A:
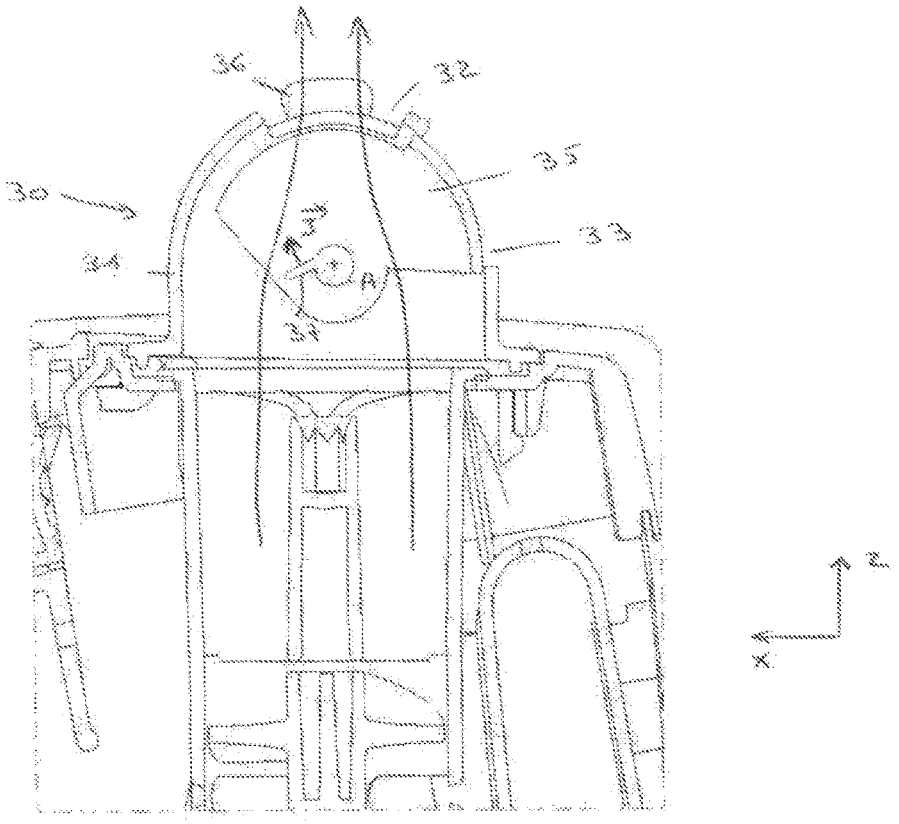
FIGS. 7*a* and 7*b* illustrate the operation of an apparatus that is a subject of the invention when the body of the pool cleaning apparatus moves in reverse on a substantially horizontal surface after having left a substantially vertical surface.
Figure 7B:
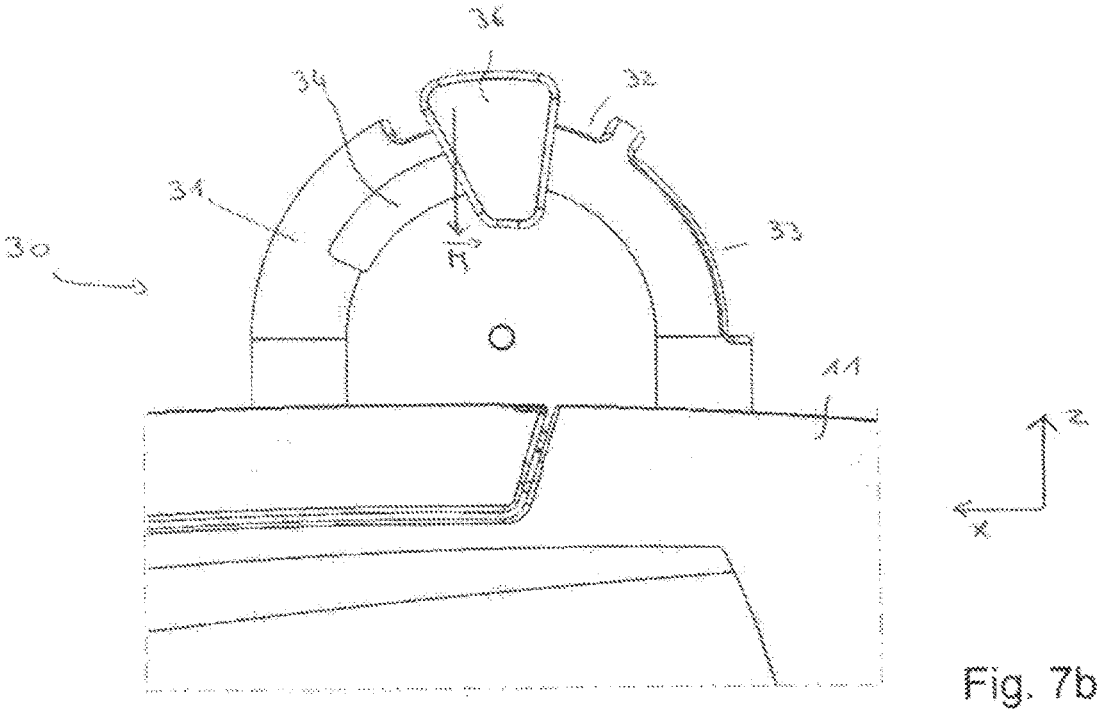

FIGS. 5*a* and 7*b* show the position of the closure device 35 when the pool cleaning apparatus 10 is located in the water of the pool, when said pool cleaning apparatus 10 is moving, in use, on a surface substantially horizontal (when the pool cleaning device moves in particular at the bottom of the pool). FIG. 5*a* is a cross-sectional view, in a plane XZ, of a portion of the pool cleaning apparatus 10 at the level of the adjustment means 30 of the orientation of the liquid flow. FIG. 5*b* is a side view of a portion of the pool cleaning apparatus 10 at the level of the liquid flow direction setting means 30. The XY guide plane of the pool cleaner 10 is parallel, or tangent, to the horizontal surface of the pool. The torque exerted by the mass M of the weights 36 around the hinge axis A brings the closure device 35 into the first position (the first liquid outlet orifice 32 is plugged) (alternatively, the first portion 41 of the single outlet port 40 is closed). When the closure device is in this first position, the blade 37 is parallel to the flow of liquid escaping from the liquid outlet 14, as shown in FIG. 5*a*. The operation of the pumping motor does not change the torque applied around the hinge axis A, since the blade 37 is parallel to the flow of liquid; the closure device 35 thus always blocks the first liquid outlet orifice 32 of the nozzle body 31 (or the first portion 41 of the single outlet orifice 40 of the nozzle body 31'). The liquid flow exits the nozzle body 31 through the second liquid outlet port 33 (or exits the nozzle body 31' through the second portion 42 of the single outlet port 40). The flow of liquid, shown in FIG. 5*a* by the two arrows, is inclined relative to the XY plane toward the rear of the device.

Figure 6B:
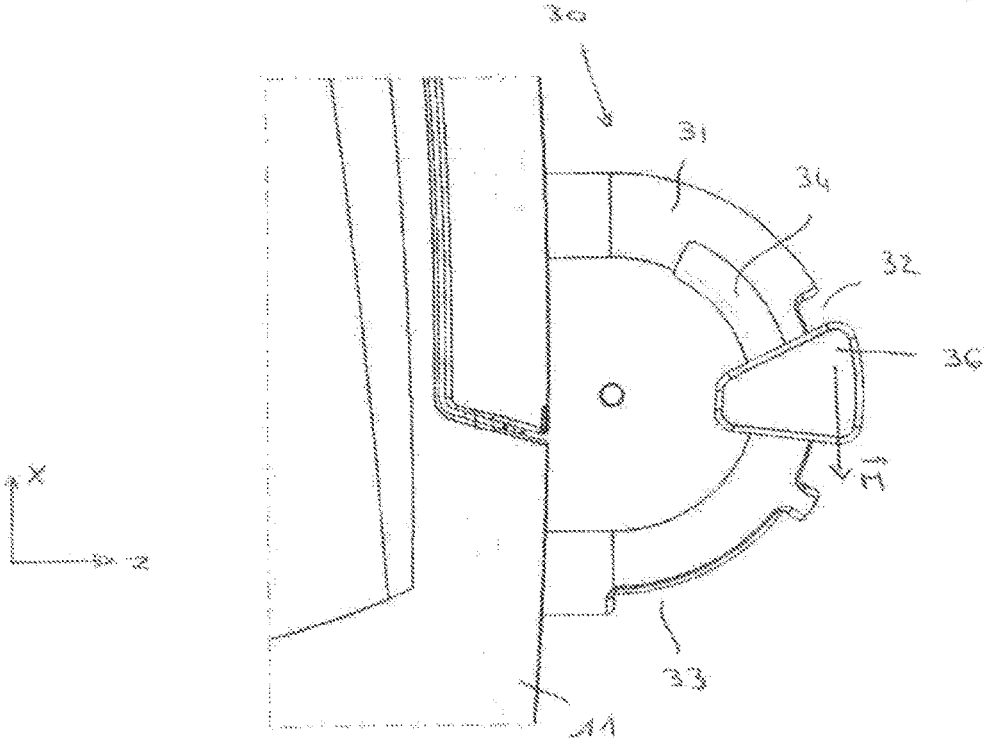

FIGS. 6*a* and 6*b* show the position of the closure device 35 when the body 11 of the pool cleaning apparatus 10 moves on the vertical wall of the basin. FIG. 6*a* is a cross-sectional view, in a plane XZ, of a portion of the swimming pool cleaning apparatus 10 in position on the vertical wall, at the level of the adjustment means 30 of the orientation of the liquid flow. FIG. 6*b* is a side view of a portion of the swimming pool cleaner 10 in position on the vertical wall at the liquid flow direction setting means 30. The XY guide plane of the pool cleaner 10 is parallel, or tangent, to the vertical wall of the pool. The torque exerted by the mass M of the weights 36 around the hinge axis A brings the closure device 35 into the second position (the second liquid outlet orifice 33 is plugged) (alternatively, the second portion 42 of the single outlet port 40 is closed), When the closure device is in this second position, the blade 37 is no longer parallel to the flow of liquid from the liquid outlet 14, as shown in FIG. 6*a*. The blade 37 partially opposes the flow of liquid from the liquid outlet 14. The liquid flow exerts a force J on the blade 37 generating an additional torque working in the same direction as the torque exerted by the Mass M of the weights 36. Such a configuration tends to maintain the closure device 35 in this second position, as long as the pool cleaning device 10 is on the vertical wall. The flow of liquid exits the nozzle body 31 through the first liquid outlet port 32 (or, alternatively, exits the nozzle body 31' through the first portion 41 of the single outlet port 40). The flow of liquid is represented in FIG. 6*a* by the two arrows. Thus, the flow of liquid leaving the pool cleaning device is substantially parallel to the bottom of the pool. The liquid flow no longer flushes the debris at the back of said pool cleaner when it has tilted from the bottom of the pool to the vertical wall.

FIGS. 7*a* and 7*b* show the position of the closure device 35 when the body 11 of the cleaning apparatus 10 moves on a horizontal surface of the basin (i.e. the bottom of the pool), immediately after having moved on a vertical wall of said basin. FIG. 7*a* is a sectional view, in a plane XZ, of a portion of the pool cleaning apparatus 10, at the level of the adjustment means 30 of the orientation of the liquid flow. FIG. 7*b* is a side view of a portion of the pool cleaning apparatus 10 at the level of the liquid flow direction setting means 30. The XY guide plane of the pool cleaner 10 is parallel, or tangent, to the horizontal surface of the pool. The torque exerted by the mass M of the flyweights 36 around the hinge axis A, tending to move the closure device 35 in the first position, plugging the first liquid outlet orifice 32 of the nozzle body 31 (or as a variant, the first portion 41 of the single outlet orifice 40 of the nozzle body 31') is smaller and opposite to the torque exerted by the blade 37 under the effect of the flow of liquid. As a result, the closure device 35 remains in the second position and the second liquid outlet orifice 33 remains plugged by the closure device 35. The liquid flow, perpendicular to the XY guide plane, is represented in FIG. 7*a* by the two arrows. The debris suction system can therefore be maintained at the nominal level without opposing the resistance of the swimming pool cleaning device 10 toward the rear.

The return of the closure device 35 in its first position (the first liquid outlet orifice 32 is plugged) is obtained by reducing the flow of liquid generated by the circulation pump below a certain predetermined non-zero threshold allowing to maintain a suction capacity of some debris on the bottom of the pool.

During this momentary reduction of the flow of liquid, said liquid flow exerts a force J on the blade 37 generating a lower torque and opposite to the torque exerted by the mass M of the flyweights 36 around the hinge axis A. Consequently, the closure device 35 switches to the first position, closing the first liquid outlet port 32. When the closure device 35 is in the first position, the blade 37 is parallel to the flow of liquid entering through the orifice 39 so the force of the flow on the blade 37 is zero. Thus, the power of the circulation pump can be brought back very quickly to its nominal level to find a maximum capacity for collecting debris.

Figure 10:
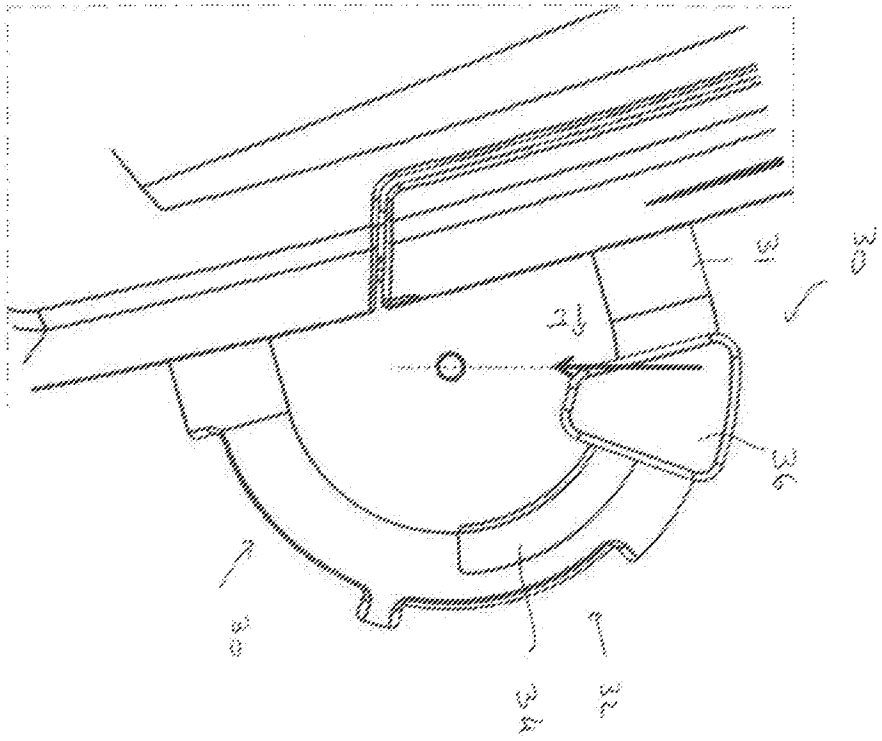
FIG. 10 illustrates the operation of the pool cleaner when the body of said pool cleaner is tilting from the horizontal surface to the vertical wall.

In the opposite direction, during the tilting of the body 11 of the pool cleaning apparatus 10 from the horizontal surface of the basin to the vertical wall, the passage from the first position to the second position of the closure device 35 is carried out when the M force—always vertical relative to the XY guide plane of the pool cleaning apparatus 10—is substantially in intersection with the hinge axis A. The tilting point between the first position of the closure device 35 and the second position of the closure device 35 is substantially given by the vertical alignment (in a fixed reference linked to the pool) between the center of gravity M of the weights 36 and the axis A of rotation of the closure device 35 as shown in FIG. 10.

In an alternative embodiment, the pool cleaning apparatus 10 comprises a return member, such as for example a torsion spring or return spring. The addition of a torsion spring can advantageously make it possible to anticipate or delay the passage of the closure device 35 from the first position to the second position when the cleaning device tilts from the bottom of the basin to the vertical wall. Such an addition will also allow a more gradual tilting of the closure device 35 between the first and the second position. A progressive change can limit the water hammer generated during the very fast passage from one position to another of the closure device. It also avoids damage to the mechanical stops of the closure device in the first or second position.

The above description dearly illustrates that by its different characteristics and advantages, the present invention achieves the objectives it has set for itself. In particular, it provides a swimming pool cleaning device suitable for cleaning the bottom and the vertical walls of a swimming pool and comprising means for adjusting the orientation of the flow of liquid easy to use, without the use of electric actuators.

Aspects of the present invention are not intended to be mutually exclusive, exhaustive, or restrictive in any way, and the invention is not limited to these example embodiments but rather encompasses all possible modifications and variations within the scope of any claims ultimately issued in connection with the invention (and their equivalents). For avoidance of doubt, any combination of features not physically impossible or expressly identified as non-combinable herein may be within the scope of the invention.

The entire contents of the Pichon Patent and the Erlich Patent are incorporated herein by this reference. Further, although applicant has described systems for use in cleaning swimming pools, persons skilled in the relevant field will recognize that the present invention conceivably may be employed in other manners as well. Finally, references to "basins," "pools," and "swimming pools" herein may also refer to spas or other water containing vessels used for recreation or therapy and for which cleaning is needed or desired.

What is claimed is:

1. A swimming pool cleaning apparatus comprising:

a cleaner body, a hydraulic circuit for liquid circulation between a liquid inlet and a liquid outlet, and through a filtration chamber, driving and guiding members of the body on a submerged surface, and defining a guide plane, adjustment means for orienting a liquid flow, arranged at or proximate the liquid outlet, wherein the adjustment means is configured to orient the flow of liquid which escapes from the liquid outlet in at least two predefined directions, one of which corresponds to a first direction inclined with respect to the guide plane and the other of which corresponds to a second direction substantially perpendicular to the guide plane, wherein the adjustment means extends at least partially above a top side of the body of the swimming pool cleaning apparatus and is adjustable to change the flow of liquid escaping from the liquid outlet.

2. Apparatus according to claim 1 wherein the adjustment means comprises (a) a nozzle body comprising (i) a first liquid outlet port configured to allow liquid coming from the liquid outlet to exit in the second direction and (ii) a second liquid outlet port configured to allow the liquid coming from the liquid outlet to exit in the first direction, and (b) a closure device configured to close off either the first liquid outlet port or the second liquid outlet port.

3. Apparatus according to claim 2 wherein the closure device, in a first position, closes only the first liquid outlet port when the cleaner body, in use, moves on a horizontal surface.

4. Apparatus according to claim 3 wherein the closure device, in a second position, closes only the second liquid outlet port when the cleaner body, in use, moves on a vertical surface.

5. Apparatus according to claim 2 wherein the adjustment means further comprises at least one flyweight fixedly attached to the closure device.

6. Apparatus according to claim 2 wherein the adjustment means further comprises a blade fixedly attached to the closure device.

7. Apparatus according to claim 1 wherein the adjustment means comprises (a) a nozzle body having a single outlet orifice arranged to allow liquid to exit from the liquid outlet in the first and second directions and (b) a closure device configured to close off (i) a first portion of said single outlet orifice so as to allow liquid coming from the liquid outlet to exit in the first direction or (ii) a second portion of said single outlet port so as to allow the liquid from the liquid outlet to exit in the second direction.

8. Apparatus according to claim 7 wherein the closure device, in a first position, closes only the first portion of the single outlet orifice when the cleaner body, in use, moves on a horizontal surface.

9. Apparatus according to claim 8 wherein the closure device, in a second position, closes only the second portion of the single outlet orifice when the cleaner body, in use, moves on a vertical surface.

10. Apparatus according to claim 1, wherein the liquid outlet is defined in the top side of the cleaner body, and wherein a flow path of the liquid is defined from the liquid outlet and through the adjustment means.

11. An autonomous swimming pool cleaner comprising:

a. a cleaner body having an exterior surface and defining a liquid inlet and a liquid outlet;

b. means, at or proximate the outlet, for receiving a flow of liquid exiting the liquid outlet and orienting the flow of liquid exiting the liquid outlet alternatively in a first direction or a second direction, wherein the means for orienting a flow of liquid is located external to the cleaner body, wherein the means for receiving and orienting the flow of liquid comprises a nozzle body protruding from the exterior surface;

c. means for driving and guiding the cleaner body on a submerged surface of a swimming pool, such means defining a guide plane, wherein the first direction is inclined with respect to the guide plane and the second direction is substantially perpendicular to the guide plane.

* * * * *